US006684468B1

(12) United States Patent
Luján

(10) Patent No.: US 6,684,468 B1
(45) Date of Patent: Feb. 3, 2004

(54) MICROFIBER STRUCTURE

(76) Inventor: Dardo Bonaparte Luján, Belgrano 2270, 1° "J" , Mar del Plata, 7600 Province of Buenos Aires (AR)

( * ) Notice: Subject to any disclaimer, the term of this patent is extended or adjusted under 35 U.S.C. 154(b) by 0 days.

(21) Appl. No.: 10/265,851

(22) Filed: Oct. 7, 2002

(51) Int. Cl.[7] ..... D04H 3/00
(52) U.S. Cl. ..... 28/103; 28/121; 28/283
(58) Field of Search ..... 28/103, 107, 116, 28/112, 100, 121, 122, 124, 289, 282, 283, 134, 143, 140, 166; 156/167, 180, 441, 148; 428/911; 442/402, 407; 2/2.5

(56) References Cited

U.S. PATENT DOCUMENTS 3,148,101 A * 9/1964 Allman, Jr. et al. ..... 156/167
3,523,059 A * 8/1970 Coates ..... 156/148
3,641,638 A * 2/1972 Laible ..... 28/112
3,673,036 A * 6/1972 Lipe ..... 28/282
3,689,344 A * 9/1972 Bolliand et al. ..... 28/282
4,217,387 A * 8/1980 Viezee et al. ..... 28/103
4,392,903 A * 7/1983 Endo et al. ..... 28/103
4,741,151 A * 5/1988 Klink et al. ..... 28/271
5,569,528 A * 10/1996 Van der Loo et al. ..... 28/103
5,806,154 A * 9/1998 Tolbert ..... 28/103
5,935,881 A * 8/1999 Abiru et al. ..... 28/282
2003/0022583 A1 * 1/2003 Thomas et al. ..... 28/107

* cited by examiner

*Primary Examiner*—Amy B. Vanatta
(74) *Attorney, Agent, or Firm*—David W. Carstens; Carstens Yee & Cahoon, LLP

(57) ABSTRACT

A process and apparatus for manufacturing a microfiber structure for absorbing impact energy, sound energy and/or temperature, the structure being used in the ballistic field and in the sound and temperature isolation fields, wherein the method comprises to provide a plurality of threads consisting of microfibers, subjecting the threads to a pressurized air jet to open the threads by separating the microfibers into each thread and entangling the threads to form a mass of loosely-entangled microfibers, with the mass being confined the mass into a pack which may be appropriately compacted.

27 Claims, 3 Drawing Sheets

MICROFIBER STRUCTURE

BACKGROUND OF THE INVENTION

1. Field of the Invention

The present invention relates to the field of light structures for manufacturing packs, panels, or any other element for absorbing impact and shock energy, sound energy, for isolating spaces from temperature, and preferably the invention relates to a process for obtaining a light structure composed of threads and microfibers, preferably employed in the ballistic field for manufacturing antitrauma ballistic jackets, armored panels and any other element for absorbing the energy of a bullet and retaining the bullet trapped into the microfiber structure, thus preventing a bullet or any other impinging objet from passing through the jacket or panel or similar element for protecting the user.

While specific reference may be made in this specification to the application of the inventive structure in the ballistic field, this structure is well applied to the temperature and sound isolation field.

2. Description of the Prior Art

It is well known to provide synthetic fibers or threads like aramids for manufacturing ballistic jackets or armored panels for armoring cars, for example. The concept employed for manufacturing this armored products were based in providing combined woven materials and resin materials strong enough and having a high resistance so as to present a solid barrier to a projectile in order to stop the projectile against a "wall" formed generally by a compact panel. The projectile generally impinges against these solid materials and deform. The excessive weight of these materials causes these armored or ballistic jackets and panels to be uncomfortable for personal use and no cost effective for use in cars.

Other jackets and panels employ the above mentioned synthetic fibers forming a mat or a plurality of mats and webs or fabrics. These webs and fabrics are woven with threads forming warps and wefts thus leaving a lot of free spaces, interstices and voids, particularly in the weft-warp crossings and, while a plurality of layers of these webs are employed to manufacture a panel or jacket, any impinging object, particularly a bullet having a sharp tip, may pierce and run through the interstices in the multi layer pack.

Both, the solid or multi layer packs, panels or jackets, do not address the penetration problem by trying to form a kind of "spider web" to receive the projectile and retain the same into the web. The several ballistic packs neither took advantage of the rotation that a projectile is provided of when shoot from a corresponding weapon. This rotation could be used for facilitating the trapping of the bullet into the pack.

It would be therefore convenient to have a convenient and light structure to manufacture any kind of ballistic jacket, armored panel and similar elements for trapping any projectile impinging on the panel or jacket and preventing the projectile from passing through the structure. It would also desirable that the structure be useful for isolating sound and temperature.

SUMMARY OF THE INVENTION

It is therefore one object of the present invention to provide a new method for manufacturing a light structure made of threads and microfibers, wherein the structure is based in a shapeless fiber-entangled mass capable of being shaped into any desired shape to form ballistic jackets, armored panels, temperature isolating panels or sound isolating panels. The entangled fibers, microfibers or threads in the structure are arranged in such aleatory and/or curling pattern that no voids, interstices or free spaces are provided for preventing any impinging projectile, sound wave or heat front passing through the structure.

It is still another object of the present invention to provide a process and apparatus for manufacturing a microfiber structure for absorbing impact energy, sound energy and/or temperature, the structure being used in the ballistic field and in the sound and temperature isolation fields, wherein the method comprises to provide a plurality of threads consisting of microfibers, subjecting the threads to a pressurized air jet to open the threads by separating the microfibers into each thread, and entangling the threads to form a mass of loosely-entangled microfibers, with the mass being confined into a pack which may be appropriately compacted.

It is even another object of the present invention to provide a process and apparatus for manufacturing a microfiber structure for absorbing impact energy, preferably from a bullet provided with rotating movement, wherein the inventive structure is formed into a fiber-entangled structure, with the fibers forming preferably curls, thus taking advantage of the rotation of the bullet and causing the bullet to be wrapped by the fibers or curls when penetrating the structure. When wrapped by the fibers the bullet increases its mass and size and it is prevented from passing through the structure.

It is a further object of the present invention to provide a process for obtaining a microfiber structure for use in absorbing at least one of impact energy, sound energy and temperature, the method comprising the steps of:

i. providing a plurality of spools containing polymeric threads, each thread consisting of microfibers;

ii. unwinding from the spools the threads and guiding the threads into a collecting-guiding means;

iii. pulling the threads from the collecting-guiding means;

iv. bringing the threads into a microfiber separating station for transversely separating the microfibers into the threads but maintaining the longitudinal continuity of the microfibers into each thread;

v. bringing the separated and spaced apart microfibers into entangling means for entangling the threads all together to form a mass of loosely-entangled microfibers;

vi. providing an outer cover all around the mass in order to confine the mass into a pack; and vii. compacting the pack.

It is even another object of the present invention to provide an apparatus for manufacturing a microfiber structure according to the method of claim 1, the apparatus comprising, i. a support including a plurality of spools containing polymeric threads, each thread consisting of microfibers;

ii. pulling means for pulling and unwinding the threads from the spools;

iii. collecting-guiding means for collecting the threads from the spools and guiding the threads into the pulling means;

iv. a microfiber separating station for transversely separating the microfibers into each thread and maintaining the longitudinal continuity of the microfibers into each thread; and v. entangling means for receiving the threads with their microfibers separated in the separating station and for entangling all the threads together to form a mass comprising loosely-entangled microfibers.

It is still a further object of the present invention to provide a process for obtaining a microfiber structure for use in absorbing at least one of impact energy, sound energy and thermal energy, the method comprising the steps of:

i. providing a plurality of spools containing polymeric threads, each thread consisting of microfibers;

ii. unwinding from the spools the threads and guiding the threads into a collecting-guiding means;

iii. pulling the threads from the collecting-guiding means;

iv. bringing the threads into a microfiber separating station for transversely separating the microfibers into the threads but maintaining the longitudinal continuity of the microfibers into each thread;

v. bringing the separated and spaced apart microfibers into entangling means for entangling the threads all together to form a mass of loosely-entangled microfibers; and vi. wrapping longitudinal portions of the mass around a core support to form a pack.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
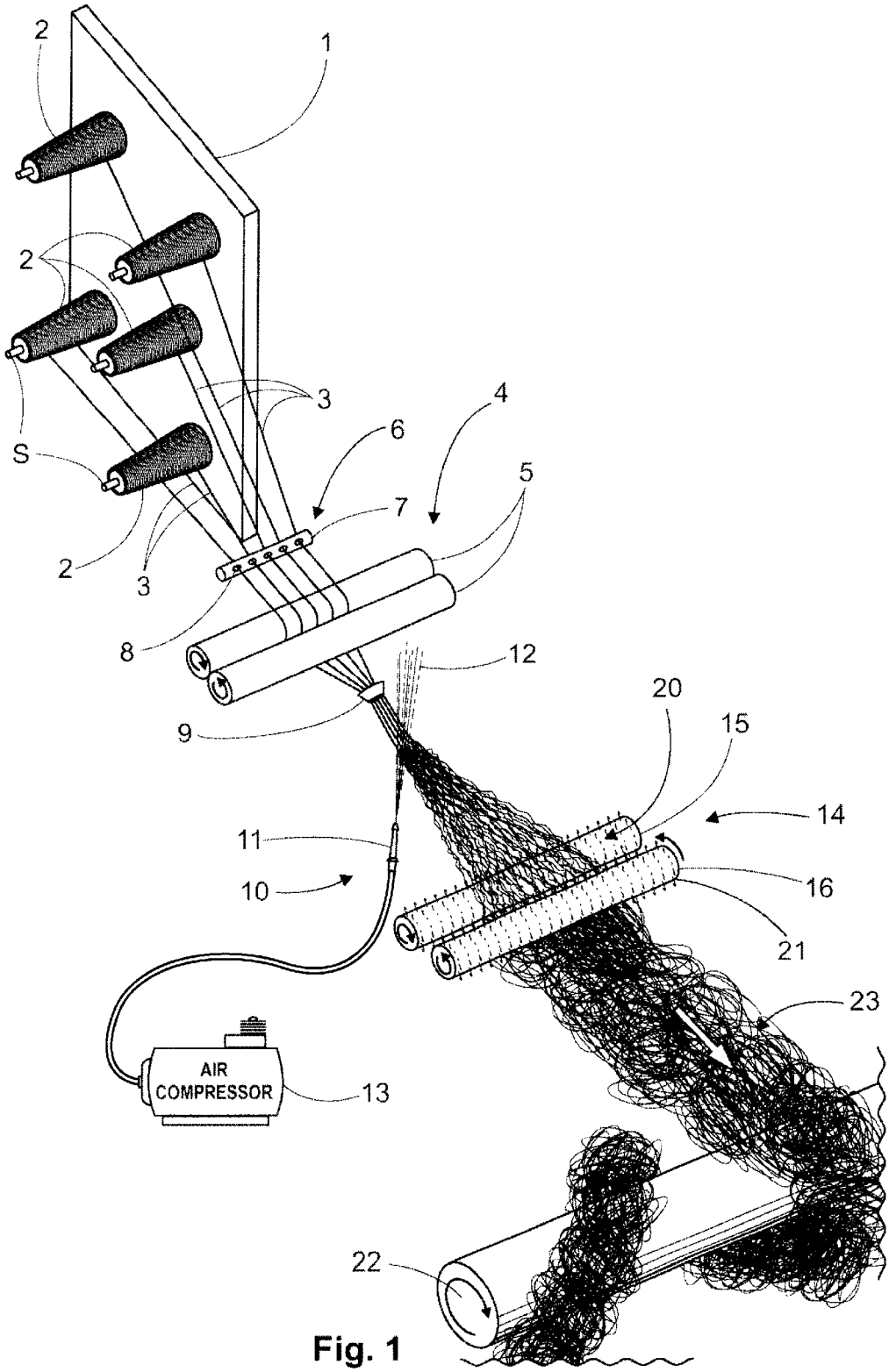
FIG. 1 shows a perspective, diagrammatical view of an apparatus of the invention carrying out the inventive method for obtaining the entangled microfibres.

Now referring in detail to the drawings it may be seen from FIG. 1 that a preferred apparatus may be employed to carry out the method of the invention, for manufacturing a microfiber structure. According to the invention, the apparatus comprises a support board 1 including a plurality of spools 2 each one containing a polymeric thread consisting of a plurality of fibers or, also called microfibers. The threads and fibers employed in this invention are preferably high tensile fibers, threads, yarns, etc., such as those known in the market under the names aramid, polyester, synthetic threads, Kevlar® (aramid fibers), Twaron® (aramid fibers), Dyneema® (ultra high resistance polyethylene fibers), roving (thread fibers), Carbon and/or mixtures thereof. Each spools 2 is preferably mounted in a rotatably manner in a shaft S which in turn is connected to the support board, and shafts S may be horizontally or vertically arranged in the support.

The apparatus also comprises pulling means 4 comprising two cylinders 5 rotating in opposite directions, as indicated by the arrows at one end of the cylinders, for pulling and unwinding the threads from the spools. The cylinders may be made of any convenient material, metal or plastics, or lined by any gripping material such as rubber.

Before entering between the cylinders, the threads passes through collecting-guiding means 6, preferably comprising a length of tube 7 provided with a plurality of transverse orifices 8 with each orifice being arranged for receiving one thread passing therethrough and for keeping the threads close to each other. Thus, the threads are collected from the spools and guided into the pulling means.

A complementary guiding sleeve 9 may be also provided to better keep together the threads before entering into a microfiber or fiber separating station 10 for transversely separating the microfibers into each thread and maintaining the longitudinal continuity of the microfibers into each thread. Station 10 preferably comprises at least one air ejecting nozzle 11 providing a pressurized air jet 12 ejected transversely to the threads exiting the pulling means. Nozzle 11 may be connected to an air compressor 13.

The microfiber or fiber separating station may be anyone for transversely separating the microfibers into the threads but for maintaining the longitudinal continuity of the microfibers into each thread, that is, while the microfibers composing a thread are spaced apart or separated in the. separating station, such microfibers remain continuous into the thread in order to guarantee the thread continuity, resistance and strength, particularly the tensile strength.

When exiting separating station 10, the threads present their fibers separated from each other but still integrated within the corresponding thread. Under these conditions the threads are fed into a entangling means 14 comprising at least one non abrasive rough surface, for receiving the threads with their microfibers separated in the separating station and for entangling all the threads together to form a mass comprising loosely-entangled microfibers.

Figure 2:
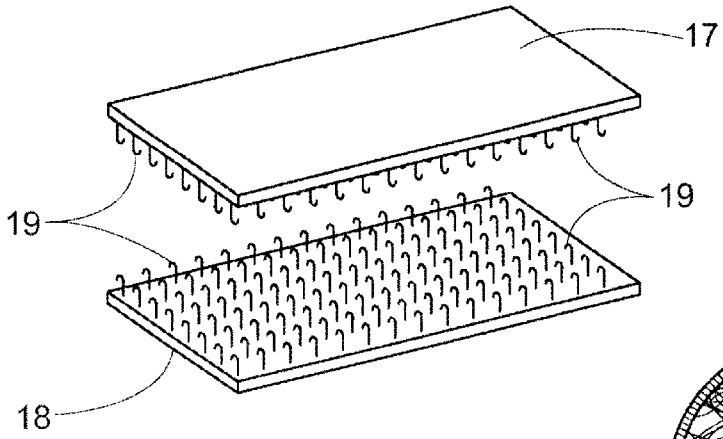
FIG. 2 shows a perspective, diagrammatical view of another embodiment of the entangling means to be used in the apparatus of FIG. 1.
Figure 3:
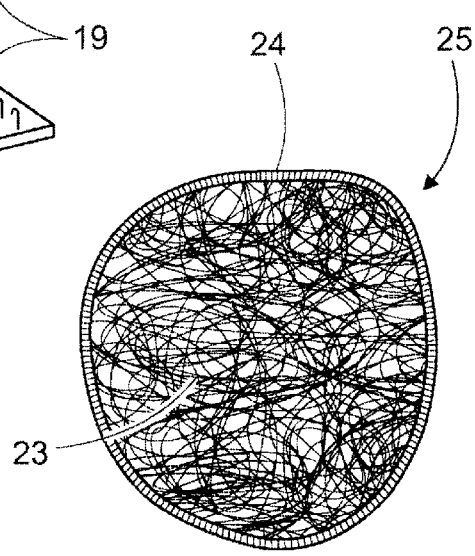
FIG. 3 shows a cross sectional view of the microfiber structure of the invention, confined into a wrap or outer cover, before compaction.

The entangling means may comprise any means with a rough non abrasive surface such as a plurality of hook-shaped projections, or a plurality of nail projections. These rough surface may be provided in one or more plates as illustrated in FIG. 2 with the threads passing over one the plates or between the plates. The plates may be stationary or provided with relative movement. If two plates 17, 18 are provided, the same should be faced to each other and close enough to receive the threads therebetween and entangling the threads through the rough surface, hook-shaped projections 19 for example, provided in their facing sides. Plates 17, 18 may be flat as illustrated or may be curved.

According to FIG. 1, entangling means 14 preferably comprise at least two cylinders 15 and 16 rotating in opposite directions as indicated by the arrows at the ends of the cylinders. In this embodiment, cylinders 15, 16 include respective outer non abrasive rough surfaces 20, 21, which surfaces are preferably comprised of projections, such hook-shaped projections or nail projections. These projections may be like the ones of plates 17, 18.

The term "entangling" must be understood in this specification as a generic term including the actions of carding, entangling, wrinkling, rumpling, disheveling, etc. which action has the purpose of arranging the threads and microfibers aleatory and, even loosely, accommodated into a formless, shapeless, amorphous, body or mass, with the threads and microfibers being arranged for preventing any free direct passage being formed through the body, mass or structure. The threads and microfibers are most preferably carded and entangled in a manner to form loops, curls, or ringlets. As will be explained in connection to FIGS. 6–8, these curls will be wrapped around the projectile when it enters the mass with a spinning or rotating movement as shoot from the corresponding weapon.

At the exit of the entangling station, a rolling cylinder 22 may be provided for receiving the entangled threads and for rolling up the threads or forming the threads into rolls, for storage purposes.

According to the method of the invention, the microfiber structure is manufactured by the steps of:

i. providing a plurality of spools 2, which spools are preferably freely rotatably mounted in corresponding shafts connected to a support, with the spools containing the polymeric threads 3, wherein each thread consists of fibers, microfibers or filaments and the threads are selected from the group comprising aramid threads, polyester threads, synthetic threads, Kevlar®, Twaron®, Dyneema®, Roving®, and mixtures thereof;

ii. unwinding from the spools the threads and bringing the threads into the collecting-guiding means 6;

iii. pulling the threads from the collecting-guiding means;

iv. bringing the threads into separating station 10, thus passing the threads through pressurized air jet 12 ejected transversely to the threads from an air ejecting nozzle, therefore transversely separating the microfibers into the threads but maintaining the longitudinal continuity of the microfibers into each thread;

v. bringing the threads with their separated and spaced apart microfibers into the entangling means 14 for entangling the threads all together to form a mass 23 of loosely-entangled microfibers;

vi. providing an outer cover 24 all around the mass in order to confine the mass into a pack 25; and vii. compacting the pack.

For the purposes of the present description, the term "microfiber" must be understood as encircling all kind of fibers, filaments and the like. The prefix "micro" does not refer to the fiber as being very short or short but is rather employed to refer to thinness of the fibers.

Figure 4:
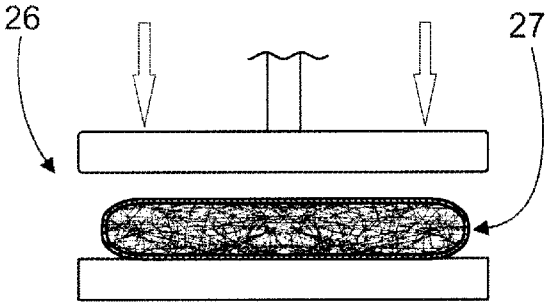
FIG. 4 shows a cross sectional view of the structure of the invention as being compacted by a press, to form a pack.

To form a pack, a determined amount of mass 23 may be wrapped into cover 24 which may comprise a laminar synthetic material, a "Kevlar" clothe, etc. Then, the pack may be compacted into a conventional press 26, as illustrated in FIG. 4. Alternatively, the pack may be compacted by extracting the air from the pack by means of a vacuum chamber not illustrated because it is a well know technique.

According to the inventive method, the threads may be guided only by passing through tube 7 or by passing through tube 7, located downstream cylinders 5, and through sleeve 9, as illustrated in FIG. 1, for guiding all the threads intimately close to each other.

The step of bringing the threads into the entangling means may comprise passing the separated microfibers through at least one non abrasive rough surface which surface may comprise a plurality of hook-shaped projections or nail projections. The at least one surface may comprise a plate or two opposing plates, either flat or curved, or at least two cylinders including respective outer non abrasive surfaces, with the surface or surfaces being non abrasive and rough, or being provided with a plurality of hook-shaped projections or nail projections.

Figure 5:
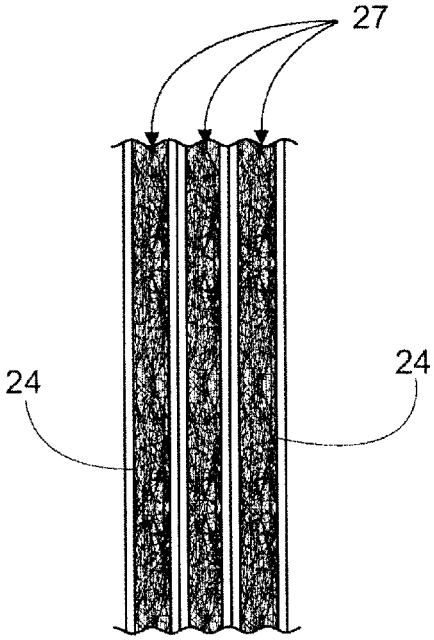
FIG. 5 shows a cross sectional view of an application of the invention comprising a multi-layer jacket or panel formed by side by side placed packs of FIG. 4.

Once the pack is compacted, as indicated by numeral reference 27 in FIG. 4, the same may be employed to form a multi layer panel or jacket as shown in FIG. 5. Panels may be adhered by any adhesive or any other appropriate means.

Figures 6, 7, 8:
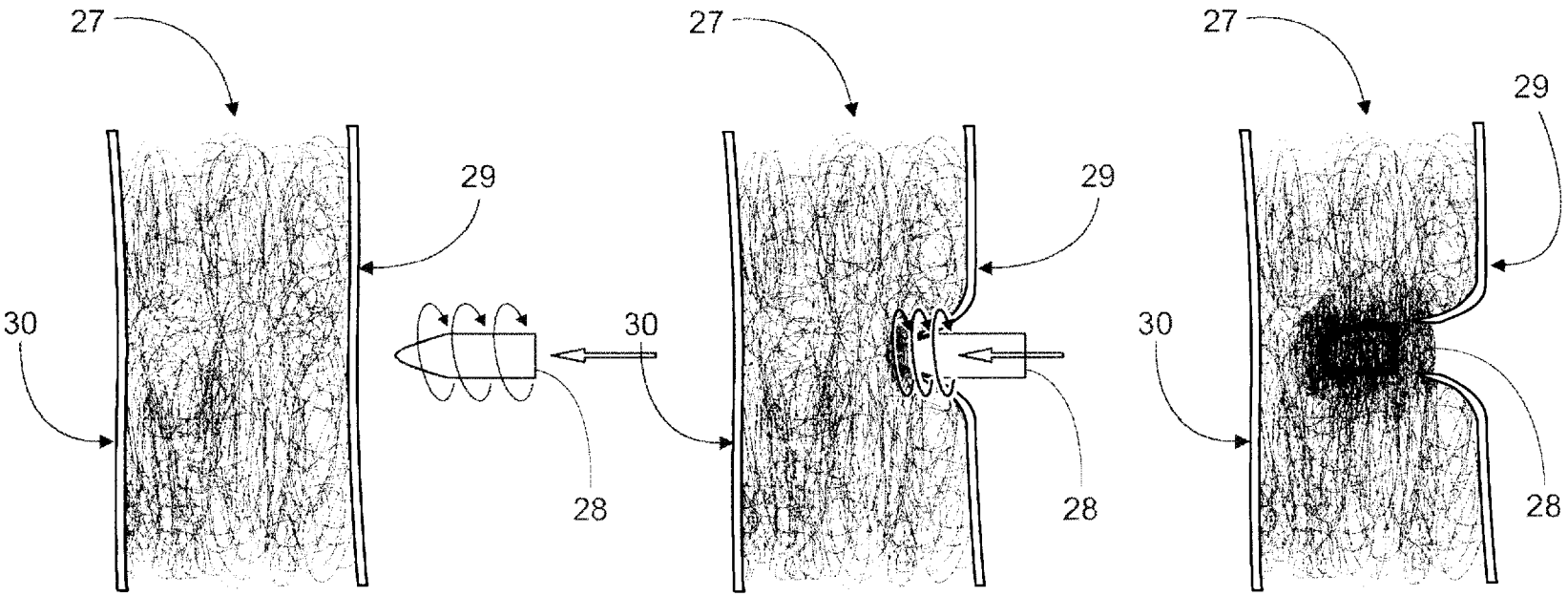
FIGS. 6–8 show three cross sectional views of the inventive structure in three different sequences, when a bullet is approaching the structure, when the bullet is entering the structure and when the bullet is trapped into the structure, respectively.

FIGS. 6–8 show three sequences of the operation of a pack of the invention when used for ballistic purposes. As it will be explained in connection to these FIGS. the entangled fiber structure of the invention operates adequately as an antitrauma ballistic panel or jacket because the bullet energy is entirely absorbed and the projectiles is retained into the structure.

As shown in FIG. 6, a bullet 28 is approaching a front face 29 of pack 27 with a spinning or rotation movement as indicated by the curved arrows. When penetrating the pack, FIG. 7, outer cover 24 is pierced and the leading tip of the bullet, which is still under rotation, enter into contact with the entangled and/or curled fibers. As a result of the rotating movement of the bullet the fibers are wrapped around the bullet and the fibers result completely retained or "adhered" to the bullet. As the bullet continues moving ahead and rotating, more fibers wrap around the bullet increasing thus the bullet size and mass, therefore trapping, stopping and retaining the bullet wrapped in the fibers mass, as shown in FIG.7. As may be seen, the bullet energy is entirely absorbed and not transmitted to a rear face 30 of the pack, thus preserving the life of the user of a ballistic jacket and preventing the user from any trauma. As resulted from the several tests, the bullet is finally deformed into the entangled mass and the fibers closest to the bullet body have found embedded in the bullet metal.

The following Table shows a comparative analysis between the fiber structure of the present invention and other conventional armor systems. In this Table the plates are made of steel, Local Steel, namely Argentine made steel, and Swiss made steel.

Three kinds of ammunition are analyzed, bullets that are lined or sleeved, common bullets, and bullets with a high piercing or perforating capacity.

It may be seen from the table that the inventive structure is lighter than the conventional systems for ballistic purposes.

TABLE

| SYSTEM | CALIBER | AMMUNITION | SPEED m/s | THICKNESS mm. | WEIGHT kg/m2 |
|---|---|---|---|---|---|
| PLATE 1010 | 3.57 | Sleeved | 430 | 4 | 32 |
| National | 7.62 | Common | 855 | 19 | 162 |
| | 7.62 | Perforat. | 840 | 25 | 200 |
| PLATE 500 "S" | 3.57 | Sleeved | 430 | 2 | 16 |

TABLE-continued

| SYSTEM | CALIBER | AMMUNITION | SPEED m/s | THICKNESS mm. | WEIGHT kg/m2 |
|---|---|---|---|---|---|
| Armor Sweden | 7.62 | Common | 855 | 7 | 56 |
| | 7.62 | Perforat. | 840 | 15 | 128 |
| ARAMID (1) | 3.57 | Sleeved | 430 | 10 | 6 |
| | 7.62 | Common | 855 | 30 | 55 |
| | 7.62 | Perforat. | 840 | 35 | 77 |
| CERAMICS | 3.57 | Sleeved | 430 | 8 | 10 |
| | 7.62 | Common | 855 | 20 | 65 |
| | 7.62 | Perforat. | 840 | 30 | 85 |
| COMPOSITE | 3.57 | Sleeved | 430 | 8 | 8 |
| MATERIALS (2) | 7.62 | Common | 855 | 20 | 60 |
| | 7.62 | Perforat. | 840 | 25 | 75 |
| INVENTIVE | 3.57 | Sleeved | 430 | 10 | 4 |
| STRUCTURE | 7.62 | Common | 855 | 25 | 31 |
| | 7.62 | Perforat. | 840 | 30 | 40 |

(1) Includes Kevlar ®, Twaron ®, Dyneema ®, Spectra ®.
(2) Includes Polycarbonates.
"Perforat." means perforating ammunition.

Figure 9:
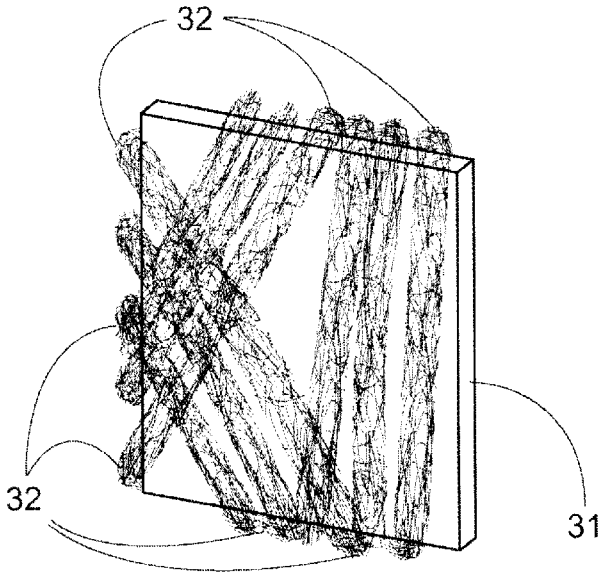
FIG. 9 shows a perspective view of another application of the method of the invention for obtaining a pack with a core support.

Still according to a further embodiment of the present invention, the step of providing an outer cover all around the mass in order to confine the mass into a pack, indicated by reference "vi" in the above disclosed method may be replaced by providing a core support such as a plate 31 illustrated in FIG. 9, made, for example, of an elastic material, such as EVA, or any other supporting material. The mass of loosely-entangled microfibers, obtained in the entangling means, may be wrapped around the core support as shown in FIG. 9, in several directions in order to prevent the formation of interstices through the several layers formed by the plurality of crossed wraps 32, of the entangled threads or fibers. The core is shown not completely covered by the thread wraps for illustrative purposes, however, the core is entirely and completely covered by the curled or entangled wraps.

While preferred embodiments of the present invention have been illustrated and described, it will be obvious to those skilled in the art that various changes and modifications may be made therein without departing from the scope of the invention as defined in the appended claims.

I claim:

1. A process for obtaining a microfiber structure for use in absorbing at least one of impact energy, sound energy and thermal energy, the method comprising the steps of:

i. providing a plurality of spools containing polymeric threads, each thread consisting of microfibers;

ii. unwinding from the spools the threads and guiding the threads into a collecting-guiding means;

iii. pulling the threads from the collecting-guiding means;

iv. bringing the threads into a microfiber separating station for transversely separating the microfibers into the threads but maintaining the longitudinal continuity of the microfibers into each thread;

v. bringing the separated and spaced apart microfibers into entangling means for entangling the threads all together to form a mass of loosely-entangled microfibers;

vi. providing an outer cover all around the mass in order to confine the mass into a pack; and vii. compacting the pack.

2. The process of claim 1, wherein the polymeric threads are selected from the group consisting of aramid threads, polyester threads, synthetic threads, aramid fibers, ultra high resistance polyethylene fibers, thread fibers, and mixtures thereof.

3. The process of claim 1, wherein the step of providing a plurality of spools comprises providing each spool freely rotatably mounted in a shaft connected to a support.

4. The process of claim 1, wherein the step of unwinding from the spools the threads and guiding the threads into a collecting-guiding means, comprises passing the threads through the collecting-guiding means consisting of a tube including a plurality of transverse orifices, each orifice for receiving one thread passing therethrough.

5. The process of claim 4, wherein the step of unwinding the threads from the spools and guiding the threads into a collecting-guiding means comprises passing each thread through one of the orifices which orifices are arranged to keep the threads close to each other.

6. The process of claim 1, wherein the step of pulling the threads from the collecting-guiding means comprises passing the threads between two pulling rotating cylinders.

7. The process of claim 1, wherein the step of bringing the threads into a microfiber separating station comprises passing the threads through a pressurized air jet ejected transversely to the threads from an air ejecting nozzle.

8. The process of claim 1, wherein the step of bringing the separated and spaced apart microfibers into an entangling means comprises passing the separated microfibers through a non abrasive rough surface.

9. The process of claim 1, wherein the step of bringing the separated and spaced apart microfibers into an entangling means comprises passing the separated microfibers through a non abrasive surface including a plurality of hook-shaped projections.

10. The process of claim 1, wherein the step of bringing the separated and spaced apart microfibers into an entangling means comprises passing the separated microfibers through a non abrasive surface including a plurality of nail projections.

11. The process of claim 1, wherein the step of bringing the separated and spaced apart microfibers into an entangling means comprises passing the separated microfibers between at least two cylinders including respective outer non abrasive surfaces, each surface being provided with a plurality of hook-shaped projections.

12. The process of claim 1, wherein the step of bringing the separated and spaced apart microfibers into an entangling means comprises passing the separated microfibers between at least two cylinders including respective outer non abrasive rough surfaces.

13. The process of claim 1, wherein the step of bringing the separated and spaced apart microfibers into an entangling means comprises passing the separated microfibers between at least two cylinders including respective outer non abrasive surfaces, each surface being provided with a plurality nail projections.

14. The process of claim 1, wherein the step of providing an outer cover all around the mass comprises wrapping a determined amount of mass into a laminar synthetic material.

15. The process of claim 1, wherein the step of compacting the pack comprises pressing the pack into a press.

16. The process of claim 1, wherein the step of compacting the pack comprises extracting the air from the pack by means of a vacuum chamber.

17. An apparatus for manufacturing a microfiber structure according to the method of claim 1, the apparatus comprising, i. a support including a plurality of spools containing polymeric threads, each thread consisting of microfibers;

ii. pulling means for pulling and unwinding the threads from the spools;

iii. collecting-guiding means for collecting the threads from the spools and guiding the threads into the pulling means;

iv. a microfiber separating station for transversely separating the microfibers into each thread and maintaining the longitudinal continuity of the microfibers into each thread; and v. entangling means for receiving the threads with their microfibers separated in the separating station and for entangling all the threads together to form a mass comprising loosely-entangled microfibers.

18. The apparatus of claim 17, wherein the collecting-guiding means comprises a tube including a plurality of transverse orifices, each orifice being arranged for receiving one thread passing therethrough and for keeping the threads close to each other.

19. The apparatus of claim 17, wherein the pulling means comprises two pulling rotating cylinders.

20. The apparatus of claim 17, wherein the microfiber separating station comprises at least one air ejecting nozzle providing a pressurized air jet ejected transversely to the threads exiting the pulling means.

21. The apparatus of claim 17, wherein the entangling means comprises at least one non abrasive rough surface.

22. The apparatus of claim 17, wherein the entangling means comprises at least one non abrasive surface including a plurality of hook-shaped projections.

23. The apparatus of claim 17, wherein the entangling means comprises at least one non abrasive surface including a plurality of nail projections.

24. The apparatus of claim 17, wherein the entangling means comprises at least two cylinders including respective outer non abrasive surfaces, each surface being provided with a plurality of hook-shaped projections.

25. The apparatus of claim 17, wherein the entangling means comprises at least two cylinders including respective outer non abrasive rough surfaces.

26. The apparatus of claim 17, wherein the entangling means comprises at least two cylinders including respective outer non abrasive surfaces, each surface being provided with a plurality nail projections.

27. A process for obtaining a microfiber structure for use in absorbing at least one of impact energy, sound energy and thermal energy, the method comprising the steps of:

i. providing a plurality of spools containing polymeric threads, each thread consisting of microfibers;

ii. unwinding from the spools the threads and guiding the threads into a collecting-guiding means;

iii. pulling the threads from the collecting-guiding means;

iv. bringing the threads into a microfiber separating station for transversely separating the microfibers into the threads but maintaining the longitudinal continuity of the microfibers into each thread;

v. bringing the separated and spaced apart microfibers into entangling means for entangling the threads all together to form a mass of loosely-entangled microfibers; and vi. wrapping longitudinal portions of the mass around a core support to form a pack.

* * * * *